US007637711B2

(12) United States Patent
Wronski et al.

(10) Patent No.: US 7,637,711 B2
(45) Date of Patent: Dec. 29, 2009

(54) APPARATUS WITH SUCTION HEAD FOR MOVING ENVELOPES

(75) Inventors: Richard E. Wronski, Barre, MA (US); Anatoly P. Kondel, Springfield, MA (US); Paul M. Gauthier, Charlton, MA (US)

(73) Assignee: MeadWestvaco Corporation, Glen Allen, VA (US)

( * ) Notice: Subject to any disclaimer, the term of this patent is extended or adjusted under 35 U.S.C. 154(b) by 528 days.

(21) Appl. No.: 11/053,275

(22) Filed: Feb. 8, 2005

(65) Prior Publication Data

US 2008/0001341 A1 Jan. 3, 2008

(51) Int. Cl.
*B65G 57/04* (2006.01)

(52) U.S. Cl. ..... 414/793

(58) Field of Classification Search ..... 414/793; 294/2, 64.1

See application file for complete search history.

(56) References Cited

U.S. PATENT DOCUMENTS

| | | | | |
|---|---|---|---|---|
| 2,893,581 | A | 7/1959 | Cushman | |
| 3,117,815 | A | 1/1964 | Creskoff | |
| 3,227,481 | A | 1/1966 | Creskoff | |
| 3,411,641 | A | 11/1968 | Dean | |
| 3,542,241 | A | 11/1970 | Middleditch | |
| 3,640,562 | A * | 2/1972 | Creskoff | 294/65 |
| 3,729,886 | A | 5/1973 | Lucas et al. | |
| 3,975,045 | A | 8/1976 | Abarotin et al. | |
| 3,976,205 | A | 8/1976 | Göransson | |
| 4,184,628 | A | 1/1980 | Schultz | |
| 4,516,762 | A | 5/1985 | Moltrasio et al. | |
| 4,635,988 | A | 1/1987 | Potters et al. | |
| 4,750,132 | A | 6/1988 | Pessina et al. | |
| 4,753,564 | A * | 6/1988 | Pearce et al. | 414/796 |
| 4,828,304 | A | 5/1989 | No et al. | |
| 4,899,518 | A | 2/1990 | Beeman et al. | |
| 4,910,944 | A | 3/1990 | Segalowitz et al. | |
| 4,911,098 | A | 3/1990 | Tabata | |
| 4,930,977 | A | 6/1990 | Beeman et al. | |
| 4,949,835 | A | 8/1990 | Beeman et al. | |
| 5,088,720 | A | 2/1992 | Beeman et al. | |

(Continued)

FOREIGN PATENT DOCUMENTS

DE 2263477 7/1973

(Continued)

OTHER PUBLICATIONS

Web page showing promotional materials for PreVac rotary vane vacuum pump (May 3, 2005).

(Continued)

*Primary Examiner*—Patrick H Mackey
*Assistant Examiner*—Gerald W McClain
(74) *Attorney, Agent, or Firm*—Steven J. Elleman; Alison R. Scheidler

(57) ABSTRACT

A system for moving envelopes including a stacking system for creating or placing stack of envelopes on a support surface. The stack of envelopes has a plurality of gaps with each gap being located between adjacent envelopes of the stack. The system further includes a suction head for applying suction to the stack of envelopes to pull air through the plurality of gaps to aid in lifting the stack of envelopes.

70 Claims, 13 Drawing Sheets

U.S. PATENT DOCUMENTS

| | | | | |
|---|---|---|---|---|
| 5,088,878 | A * | 2/1992 | Focke et al. | 414/627 |
| 5,207,412 | A | 5/1993 | Coons et al. | |
| 5,222,861 | A | 6/1993 | Focke et al. | |
| 5,232,332 | A | 8/1993 | Focke | |
| 5,425,565 | A * | 6/1995 | Rogovein et al. | 294/119.1 |
| 5,425,665 | A | 6/1995 | Kennedy | |
| 5,511,773 | A | 4/1996 | Burger | |
| 5,727,832 | A * | 3/1998 | Holter | 294/64.1 |
| 5,984,623 | A | 11/1999 | Smith et al. | |
| 5,996,314 | A | 12/1999 | Pennini et al. | |
| 6,487,833 | B1 | 12/2002 | Jaenson et al. | |
| 6,550,221 | B1 | 4/2003 | Neri | |
| 6,755,411 | B2 | 6/2004 | Janatka et al. | |
| 6,860,531 | B2 | 3/2005 | Sherwin | |
| 7,310,922 | B2 * | 12/2007 | Carrigan et al. | 53/399 |
| 2003/0120387 | A1 * | 6/2003 | Sherwin | 700/245 |

FOREIGN PATENT DOCUMENTS

| | | |
|---|---|---|
| DE | 19857614 | 6/2000 |
| FR | 2579190 | 9/1986 |
| JP | 3-32586 | 2/1991 |

OTHER PUBLICATIONS

Web page showing promotional materials for Schmalz vacuum components (May 3, 2005).

Web page showing promotional materials for Schmalz vacuum components (Jan. 27, 2004).

Web page showing promotional materials for Unigripper vacuum components (May 3, 2005).

Web page showing promotional materials for Vaccon vacuum components (Dec. 2, 2003).

Web page showing promotional materials for Piab vacuum components (May 3, 2005).

International Search Report "WO2006086160A1", mailed Jun. 23, 2006.

International Preliminary Report on Patentability, dated Aug. 14, 2007.

* cited by examiner

APPARATUS WITH SUCTION HEAD FOR MOVING ENVELOPES

The present invention is directed to an apparatus and method for moving envelopes, and more particularly, to an apparatus and method for moving envelopes utilizing suction forces.

BACKGROUND

In envelope manufacturing, processing and handling operations it may be desired to move relatively large numbers of envelopes in a rapid manner. In particular it is often desired to lift and move discreet stacks of envelopes. In order to lift and move a stack of envelopes the stack may be gripped between a pair of opposed arms and then lifted and moved.

However, the number of envelopes that can be lifted in this manner is limited. More particularly, envelopes typically have a greater thickness or a greater number of plies at certain portions (i.e. the center of the envelope) as compared to other (i.e. outer) portions of the envelope. Thus when a relatively large number of envelopes are gripped and pressed together the greater thickness at the center of the envelopes limits the compression forces that can be applied to the outer edges of the envelope, which results in an unstable gripped stack. This phenomenon can be replicated when a person attempts to grip a large number of envelopes (i.e. an envelope stack one or several feet long) between the person's arms, and the gripped stack bows outwardly until the envelopes spray apart. Accordingly, there is a need for an improved apparatus and method for gripping and moving stacks of envelopes.

SUMMARY

In one embodiment, the present invention is an apparatus and method that can securely grip and/or move a stack of envelopes. In particular, in one embodiment the invention is a system for moving envelopes including a stacking system for creating or placing stack of envelopes on a support surface. The stack of envelopes has a plurality of gaps with each gap being located between adjacent envelopes of the stack. The system further includes a suction head for applying suction to the stack of envelopes to pull air through the plurality of gaps to aid in lifting the stack of envelopes.

DETAILED DESCRIPTION

Figure 1:
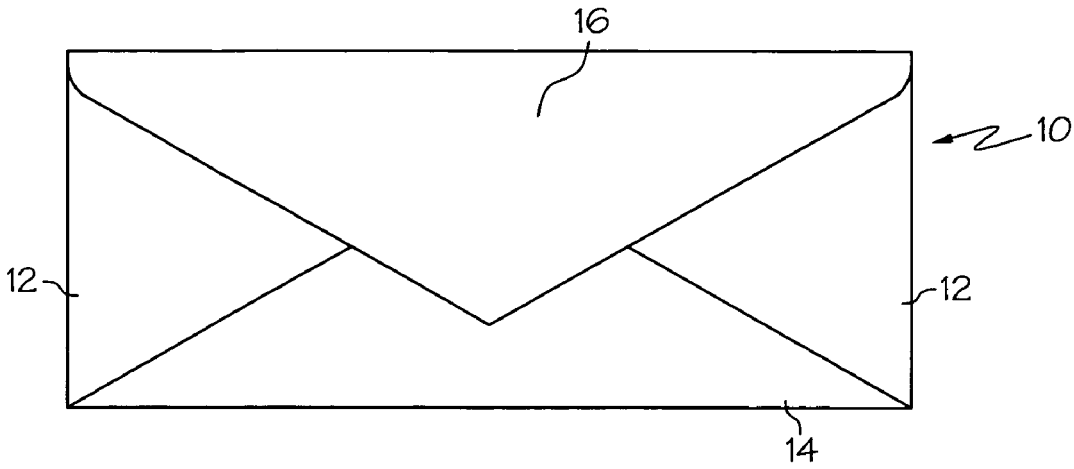
FIG. 1 is a rear view of an envelope shown in its closed position.
Figure 2:
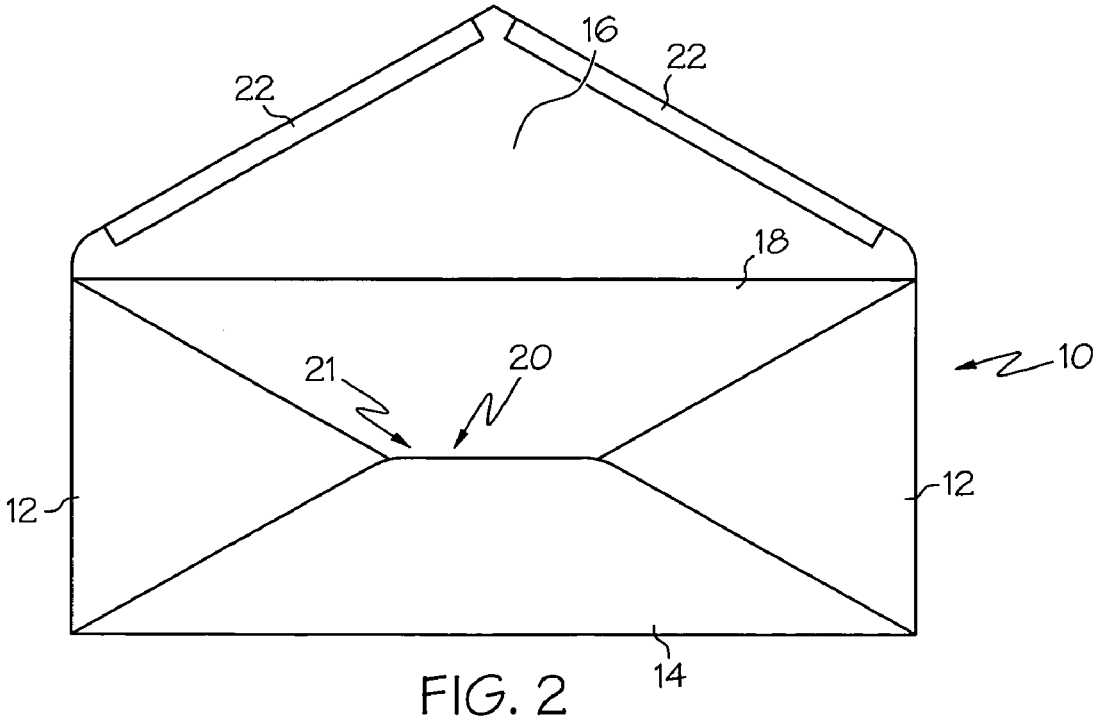
FIG. 2 is a rear view of the envelope of FIG. 1, shown in its open position.

FIGS. 1 and 2 illustrate a standard rectangular envelope 10 in its closed and open positions, respectively. The envelope 10 includes a pair of side flaps 12, a bottom flap 14, a top flap 16 (commonly called a seal flap) and a front panel 18. The side flaps 12, bottom flap 14 and top flap 16 are each foldable on top of the front panel 18 and adhered together to form the envelope 10. The top flap 16 is movable or pivotable to an open position (FIG. 2) to provide access to the inner cavity 20 of the envelope 10, and includes an adhesive strip or strips 22 to seal the envelope 10 in the well-known manner.

The inner cavity 20 includes a mouth 21 that is selectively covered by the top flap 16 (FIG. 1). However, the envelope 10 can take a wide variety of shapes and configurations beyond that specifically shown in FIGS. 1 and 2. For example, besides the diagonal seam envelope 10 shown in FIGS. 1 and 2, the envelope may be a side-seam envelope. The envelope 10 can include various windows and/or openings in the front panel 18, and may have various shapes and sizes, such as letter-sized envelopes, routing envelopes, double stuffed envelopes (i.e., a return envelope located in an outer mailing envelope) and the like.

Figure 5:
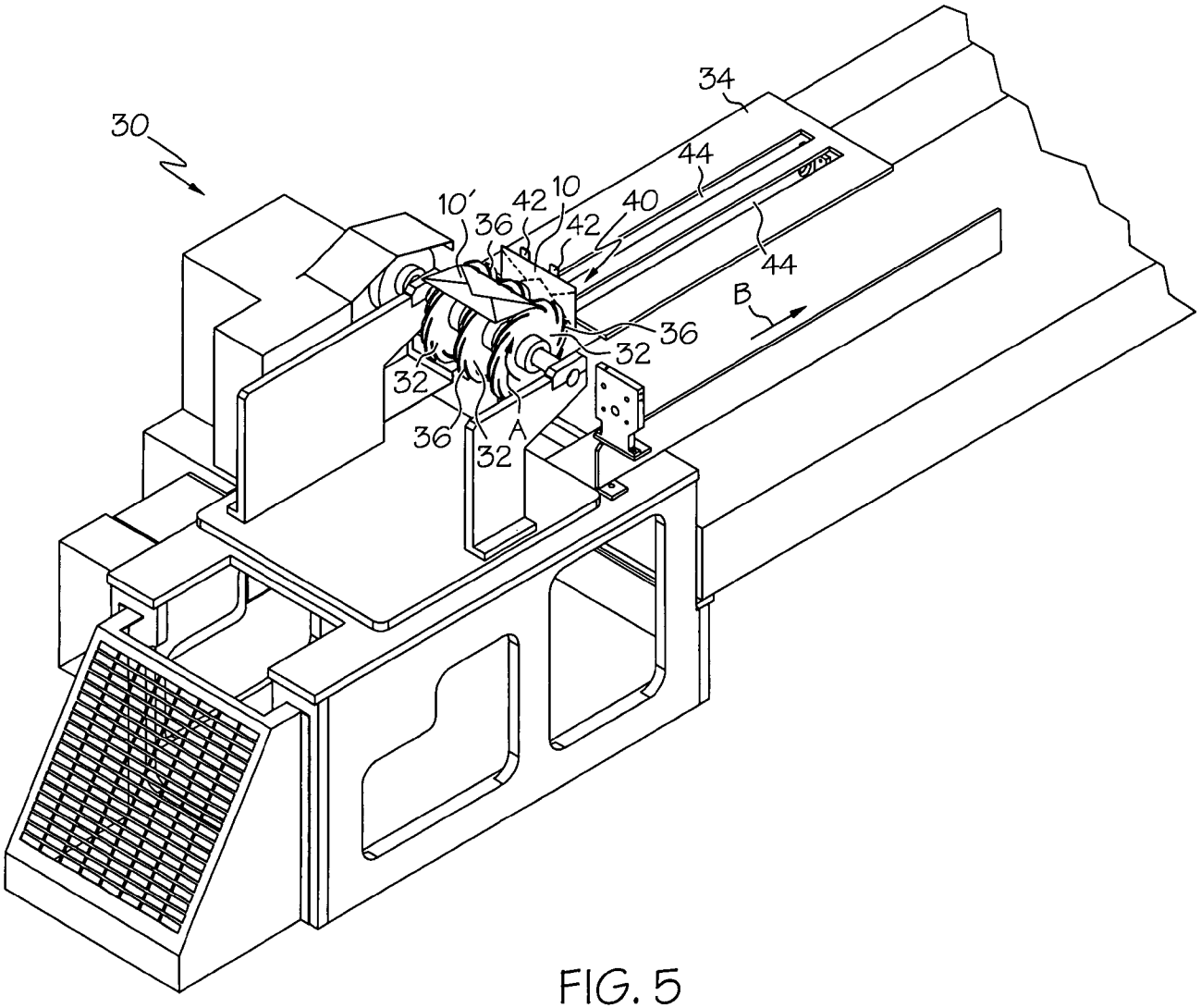
FIG. 5 is a front perspective view of an envelope processing apparatus as an envelope stack is initially formed.

A plurality of envelopes 10 may be stacked and/or compiled using a mechanized assembly, apparatus or envelope stacking machine, such as the machine 30 shown in FIG. 5. In the illustrated embodiment, the machine 30 includes a set of three co-axial spiral wheels or discs 32, also known as delivery spiders, located at the end of, or adjacent to, a support table or support surface 34. Each spiral wheel 32 includes a set of spiral slots 36 extending in a general circumferential direction out to the outer edges of the associated spiral wheel 32. Each of the spiral slots 36 is shaped to receive an envelope 10 therein (i.e., envelope 10' of FIG. 5) by an envelope feeding device (not shown) as the spiral wheels 32 rotate about their central axes.

In order to commence the stacking operation, the spiral wheels 32 are rotated in the direction of arrow A as envelopes 10 are fed into the spiral slots 36 of the spiral wheels 32. The machine 30 includes a support carriage 40 including a pair of generally vertically-extending backing bars 42 which extend through a pair of backing bar slots 44 formed in the table 34. As the spiral wheels 32 pass through or adjacent to the support carriage 40 or table 34, the lower edge of each envelope 10 that is held in the slots 36 of the spiral wheels 32 contacts the a set of stripping fingers (not shown) coupled to the table 34 and/or carriage 40, thereby retracting the envelope 10 out of the spiral slots 36 upon continued rotation of the spiral wheels 32.

The first envelope 10 deposited on the table 34 by the spiral wheels 32 engages the backing bars 42 such that the backing bars 42 provide support to the first-deposited envelope 10 (as well as subsequent envelopes 10 deposited on the table 34). In this manner, as envelopes 10 are fed into the spiral wheels 32 at an upstream location of the support table 34, the rotating spiral wheels 32 (i.e. the envelope delivery mechanism in this embodiment) continuously deposit or form an upright stack of envelopes 10 on the support table 34.

As the spiral wheels 32 continue to rotate and deposit envelopes 10, a partial stack of envelopes 48 is created on the table. However, it should be understood that instead of the spiral wheels 32, various other methods of depositing the envelopes 10 onto the support table 34 may be utilized. For example, a vacuum wheel or other similar devices may be utilized as the envelope delivery mechanism to deposit or place the envelopes 10 on the support table 34.

Figure 6:
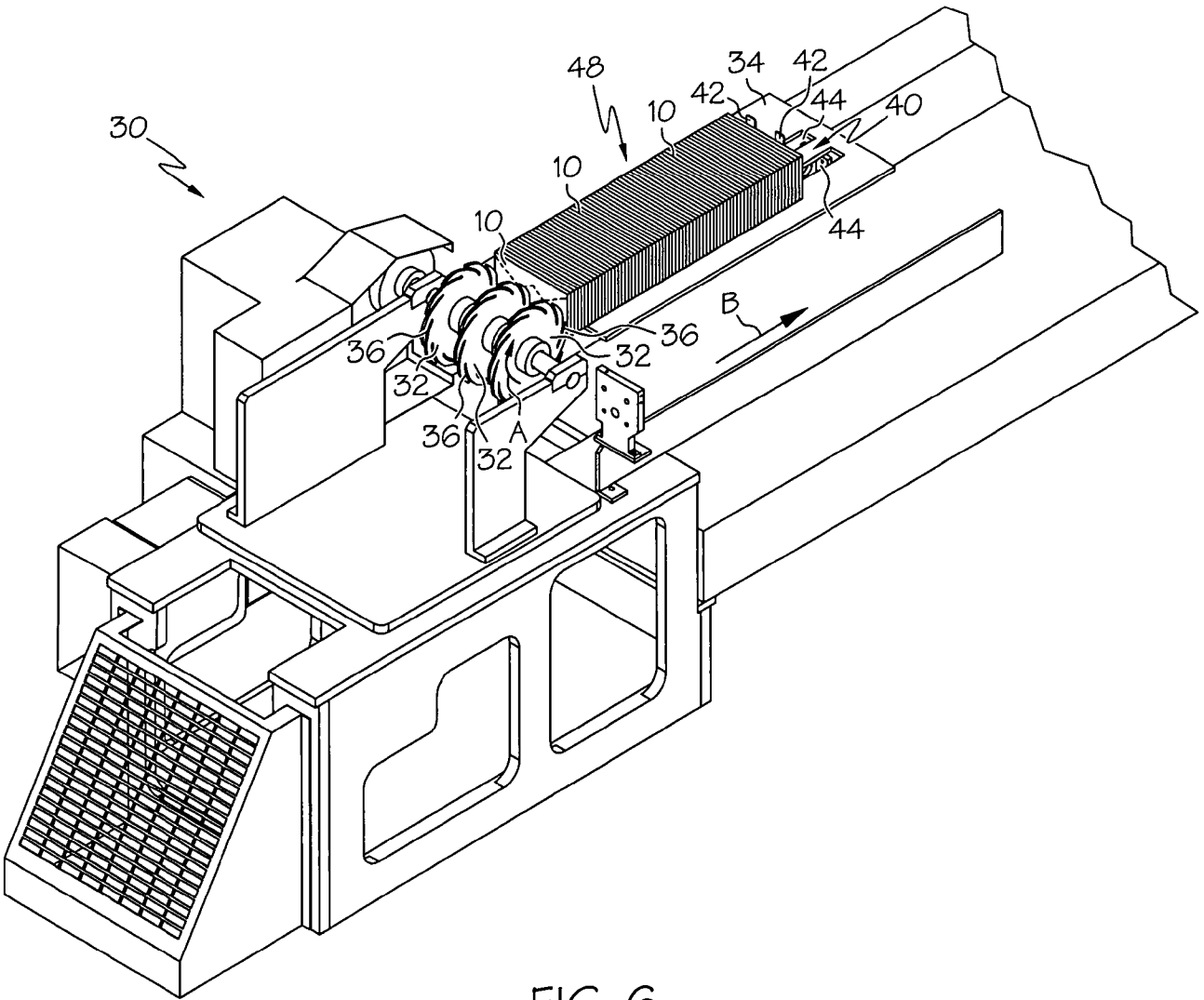
FIG. 6 is a front perspective view of the envelope processing apparatus of FIG. 5, with a fully formed envelope stack.

The backing bars 42/support carriage 40 are movable in the downstream direction B (i.e., along the length of the support table 34) to accommodate the growing length of the stack of envelopes 48. As the spiral wheels 32 continue to deposit envelopes 10 on the support table 34, the stack 48 grows and the backing bars 42/support carriage 40 move downstream to accommodate the growing stack 48. As can be seen in FIG. 6, eventually a full stack 48 of envelopes 10 is created after a predetermined number of envelopes 10 are located on the support table 34. Although the stack 48 extends generally horizontally in the illustrated embodiment, the stack 48 could also extend generally vertically if desired.

The stack of envelopes 48 created on the table 34 can include any of a wide variety of numbers of envelopes 10, such as at least about 100, at least about 500, at least about 750, at least about 1000, or less than 100 or more than 1000 envelopes, depending upon the desires of the operator. The outer edges of each envelope 10 in the stack 48 may be generally aligned such that the stack of envelopes 48 forms a generally rectangular prism. This rectangular prism can be viewed as a "slotted" rectangular prism in that a series of slots or gaps (i.e. between each adjacent envelope 10) extend throughout the height of the rectangular prism.

Figure 7:
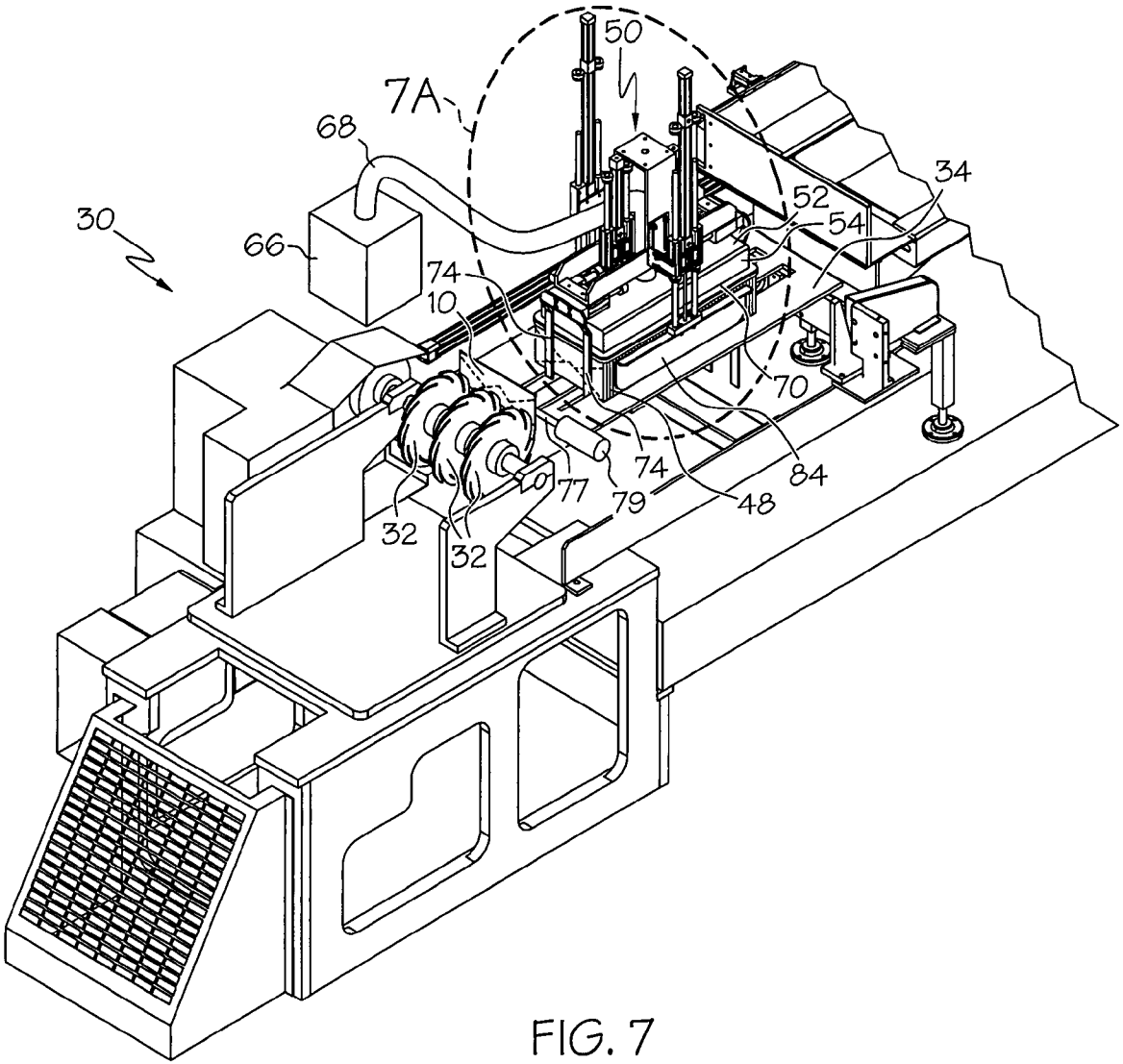
FIG. 7 is a front perspective view of the envelope processing apparatus of FIG. 6, with an envelope moving apparatus lowered over the envelope stack.

Once the full stack of envelopes 48 is created, the envelope stack 48 may be indexed downstream, such as by another set of moving fingers (not shown) that fit through the slots 44 of the table 34 at an upstream location of the stack 48. The moving fingers and backing bars 42 are then moved downstream in a coordinated manner to slide the stack 48 downstream along the table 34. Next, an envelope moving apparatus 50 is lowered on top of or adjacent to the stack of envelopes 48 (FIG. 7).

Figure 3:
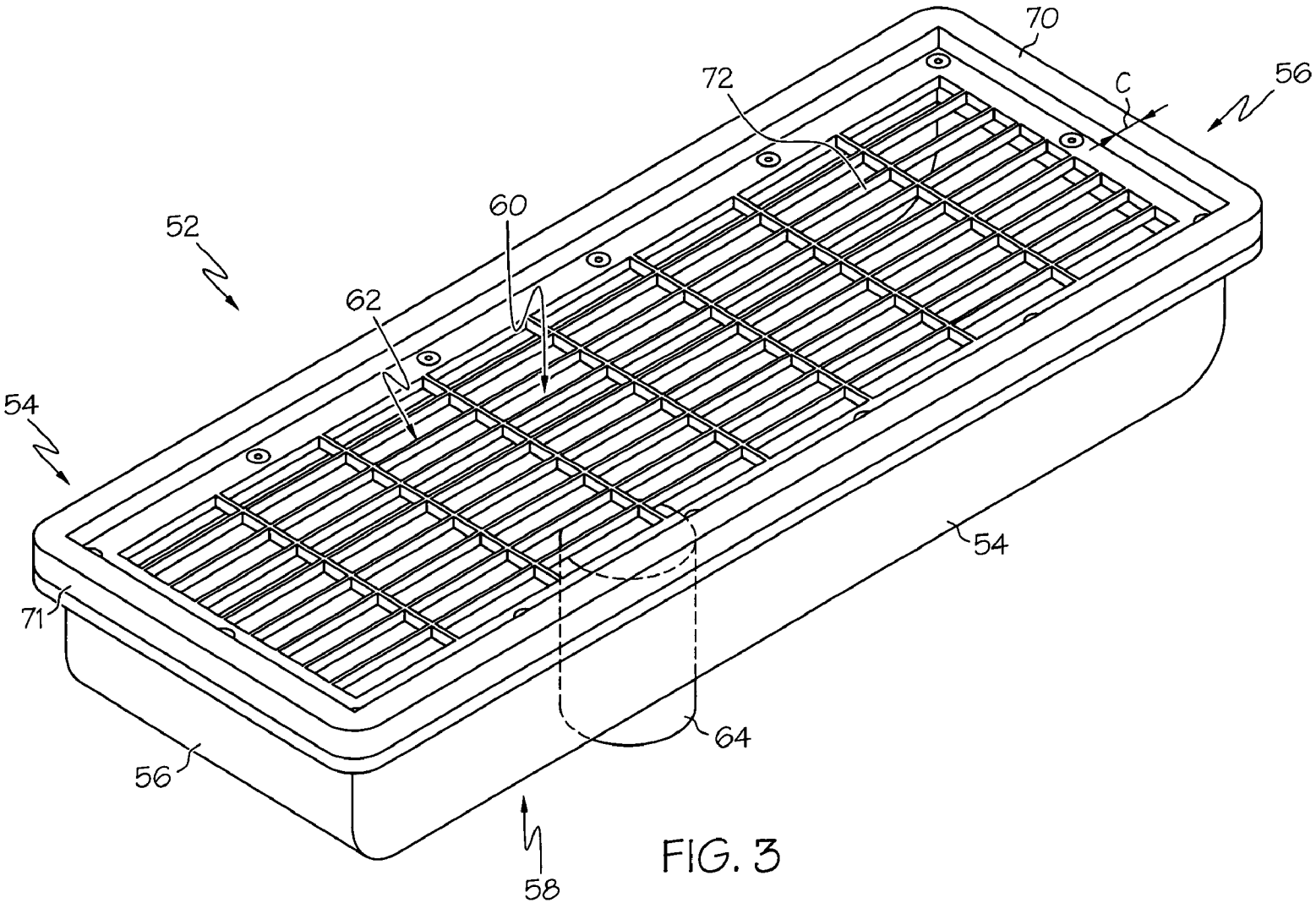
FIG. 3 is a bottom perspective view of a suction head.
Figure 4:
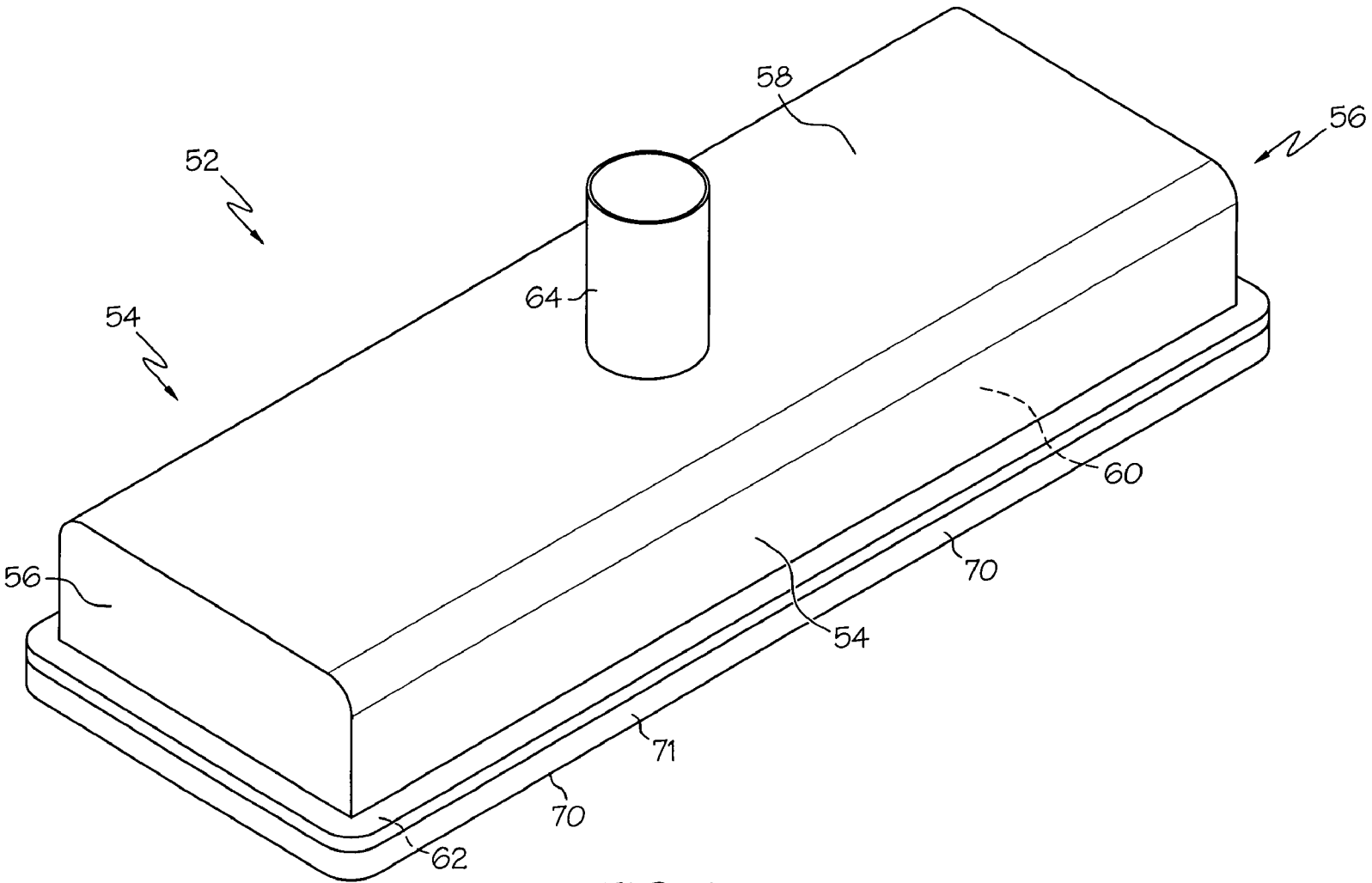
FIG. 4 is a top perspective view of the suction head of FIG. 3.
Figure 7A:
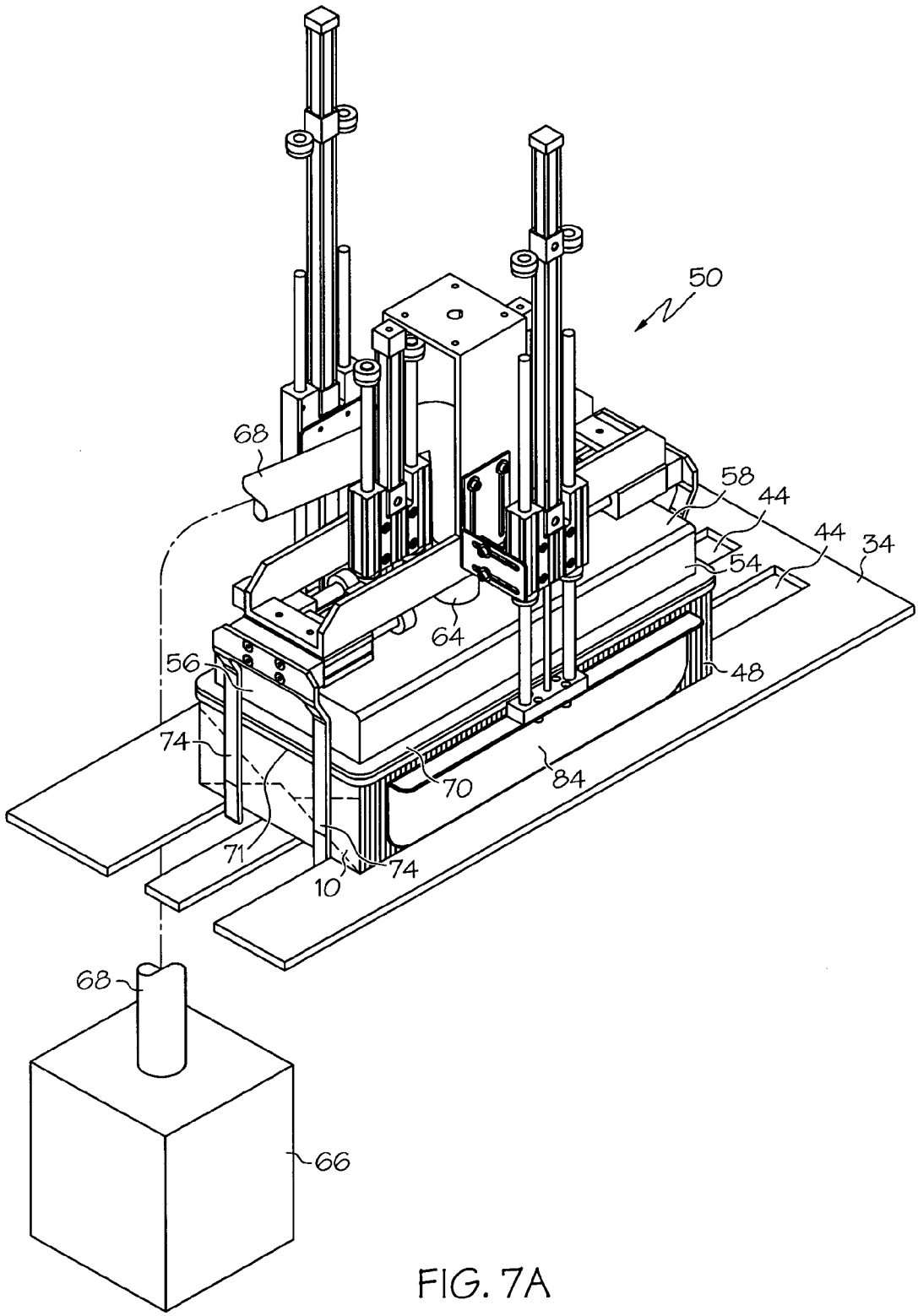
FIG. 7A is a front perspective view of the area 7A indicated in FIG. 7.

The envelope moving apparatus 50 includes a suction head or picking head 52, as shown in FIGS. 3 and 4. The suction head 52 includes a pair of opposed generally parallel side walls 54, a pair of opposed generally parallel end walls 56, and a backing wall 58 oriented generally perpendicular to the side walls 54 and end walls 56. The side walls 54, end walls 56 and backing wall 58 define a suction cavity 60 therebetween. The suction cavity 60 has a generally rectangular prism shape and has a mouth 62 located between the bottom (free) edges of the end walls 54 and side walls 56 and opposite the backing wall 58. The backing wall 58 (or alternately one of the side walls 54 or end walls 56) includes a suction port 64 formed therein which communicates with the suction cavity 60. The suction port 64 may be operatively coupled to a suction or vacuum source 66 via a connection, such as flexible tubing 68 (see FIGS. 7 and 7A). In this manner when the suction source 66 is operated a reduced pressure or suction is created in the suction cavity 60.

The suction head 52 includes a lip 71 having a generally flat lower surface 70 which extends around the perimeter of the mouth 62 of the suction cavity 60. The lower surface 70 is oriented generally perpendicular to the side walls 54 and end walls 56, and generally parallel to the backing wall 58 of the suction head 52. The lower surface 70 can have a variety of widths C (FIG. 3), but preferably has a width of at least about ¼ inch, or at least about ⅜ inch, or at least about ½ inch, or at least about 1 inch.

The lip 70 can be made of a variety of materials. For example, the lip 70 can be made of a relatively rigid or stiff material, such as metal (i.e. steel, aluminum or the like) having a hardness of at least about 25 Rockwell C, or can be made of plastic. Alternately the lip 70 can be made of a relatively soft or pliable material, such as foam (i.e. open or closed cell foam) having a hardness of less than about 60 Shore A. Thus the lip 70 can be made of porous or non-porous material. The suction head 52 can be made of a variety of materials, such as metal, plastic or the like, and the lip 70 can be made of the same materials as the suction head 52. When the lip 70 is made of foam the foam can be coupled to or located on the lower perimeter of the suction head 52.

As shown in FIG. 3, the suction head 52 includes a protrusion 72 in the form of a grid located in the mouth 62 of the suction cavity 60 to prevent envelopes 10 or other large debris from being sucked therethrough. Various other shapes or configurations of protrusions 72 besides the grid shown herein may be utilized to prevent the envelopes 10 or other debris from entering the suction cavity 60.

Figure 8:
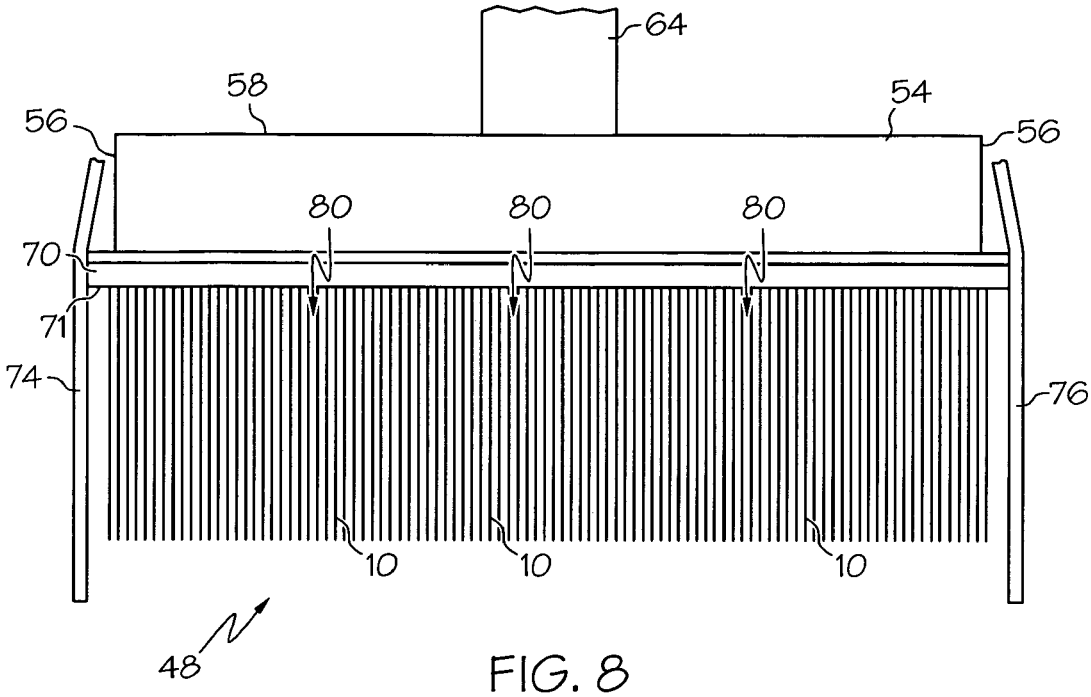
FIG. 8 is a side view of the suction head of the envelope moving apparatus and envelope stack of FIG. 7A with its gripping arms in a disengaged position.
Figure 8A:
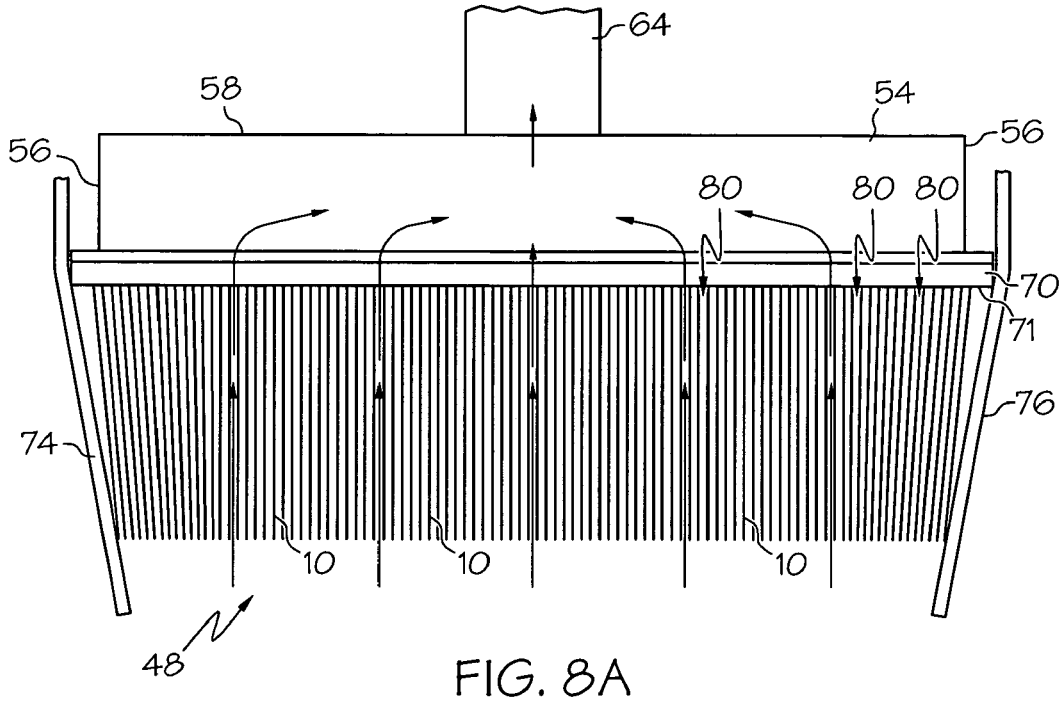
FIG. 8A is a side view of the suction head and envelope stack of FIG. 8, with the gripping arms in an engaged position.

As shown in FIGS. 7-12, the suction head 52 and/or envelope moving apparatus 50 may include a compression device in the form of a pair of opposed sets of gripping arms 74, 76. One pair of gripping arms 74 is located on or adjacent to one of the end walls 56, and the other pair of gripping arms 76 is located on or adjacent to the other opposed end wall 56. FIG. 8 illustrates the gripping arms 74, 76 in their retracted or non-gripping position. As shown in FIG. 8A, the envelope stack 48 and/or gripping arms 74, 76 are sized and configured such that the envelope stack 48 can be received between the gripping arms 74, 76.

In order to grip and lift the envelope stack 48, the envelope moving apparatus 50 and/or suction head 52 is first lowered over the envelope stack 48 (as shown in FIGS. 7A and 8-10) such that the lip 70 and/or suction cavity 60 is located on or adjacent to the envelope stack 48. The envelope moving apparatus 50 and/or suction head 52 may be lowered such that the lip 70 engages the top surface of the envelope stack 48.

Figure 8B:
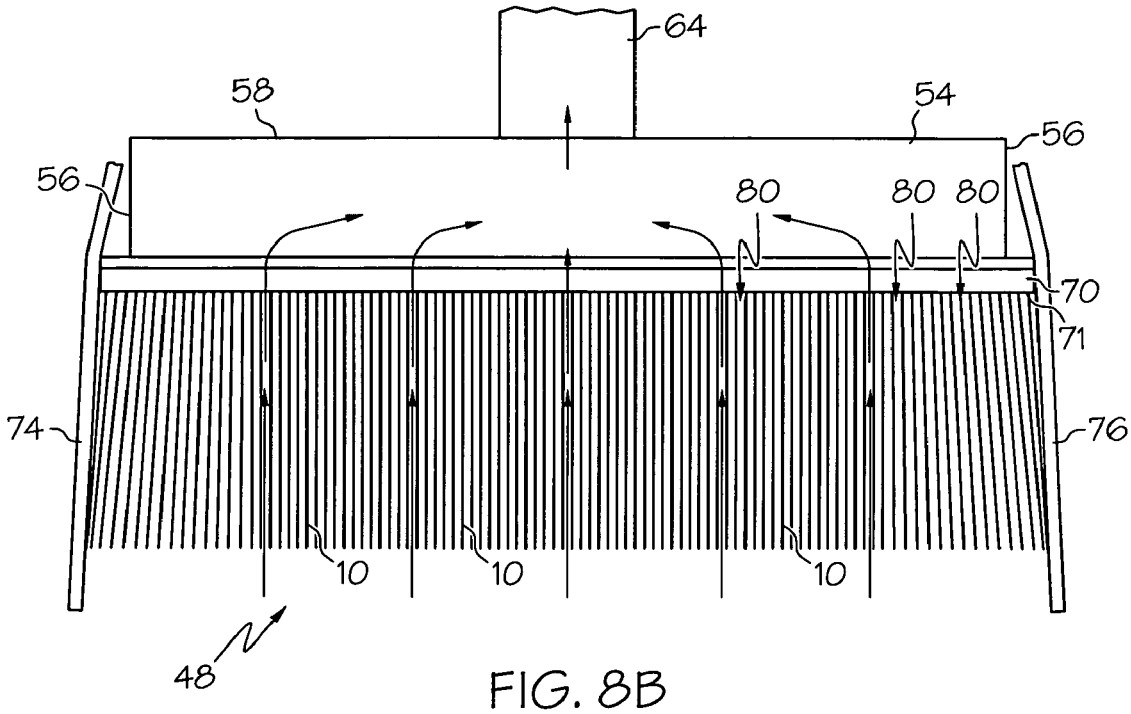
FIG. 8B is an alternate side view of the suction head and envelope stack of FIG. 8, with the gripping arms in an engaged position.
Figure 9:
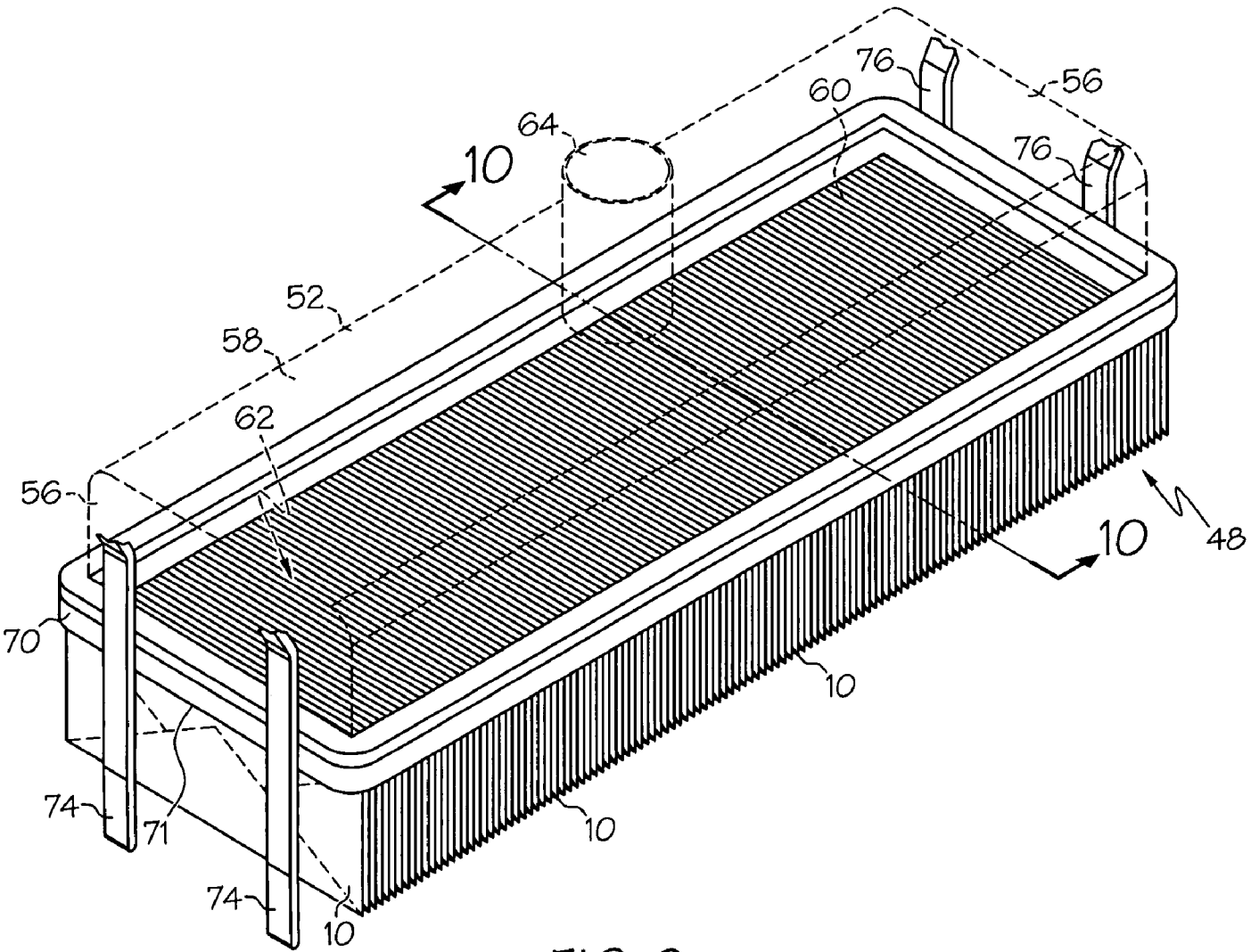
FIG. 9 is a front perspective view of the suction head and envelope stack of FIG. 7A, with portions of the suction head shown in hidden lines.

The gripping arms 74, 76 are then moved or pivoted to their gripping positions, as shown in FIG. 8A and 8B, such that the gripping arms 74, 76 compress the stack of envelopes 48 therebetween. In the embodiment shown in FIG. 8A, the lower ends of the envelope stack 48 is compressed more than the upper ends of the envelope stack 48 due to the nature of the pivoting motion of the gripping arms 74, 76. In the embodiment shown in FIG. 8B, each envelope 10 of the envelope stack 48 may an increased thickness along its upper edge. For example, each envelope 10 of FIG. 8B may include an insert (such as a coupon, advertising material or the like) and/or a top flap 16 located adjacent its upper edge which increases the thickness of the stack 48 along the upper edge of FIG. 8B. In this case the stack 48 of FIG. 8B may resist compression along its top edge and be more compressible along its lower edge, providing the outwardly-fanned shape shown in FIG. 8B.

The gripping arms 74, 76 may apply a compressive force of between about one and about seven lbs, or less than about seven lbs, or less than about five lbs. As noted above, the greater thickness at the center of the envelopes 10 (or at the top of the envelopes, as per FIG. 8B) may limit the compression at the outer edges of the envelopes 10. The arms 74, 76 may apply a compressive force to the stack of envelopes 48 such that portions of the envelopes that are not touching (i.e., the outer edges of the envelopes) are spaced apart by at least about 0.01 inches (or more particularly at least about 0.0105 inches), or at least about 0.02 inches. Thus, for example, the slots 80 in the envelope stack 48 may have a maximum width (i.e., at the location where envelopes 10 are spaced apart by their greatest distance) that is at least about 0.01 inches or at least about 0.02 inches, or less than about 0.01 inches or less than about 0.02 inches. In other words, the adjacent envelopes 10 may resist being interfacially pressed together too closely. Any of a wide variety of other mechanisms, devices or geometries, besides the gripping arms 74, 76, may be utilized to compress the envelopes 10.

When the envelopes 10 have their greatest thickness at their centers, as noted above, such a configuration can limit the compression of the envelope stack 48. However, various envelopes can have various other configurations such that the greatest thickness of the envelopes is not necessarily at their centers, but could be at other locations. Accordingly, the arms 74, 76 may apply a compressive force to said stack of envelopes 48 such that the maximum space between adjacent envelopes is least about 0.01 inches, or at least about 0.0105 inches, or at least about 0.02 inches. The slots 80 in the envelope stack 48 may have maximum width of at least about 0.01 inches or at least about 0.02 inches, or less than about 0.01 inches or less than about 0.02 inches.

The gripping arms 74, 76 need not necessarily be located on the suction head 52. For example, an alternate set of gripping arms (not shown) may be located on the table 34. These table-mounted gripping arms may be able to be manipulated such that the stack 48 is located between the table-mounted gripping arms, over-compressed therebetween. The suction head 52 can then be lowered on top of or over the table-mounted gripping arms. The suction head 52 can include a lip or a set of stationary gripping arms that receive the over-compressed stack 48 therebetween. The table-mounted gripping arms may then be lowered or retracted away from the over-compressed stack to allow the stack 48 to expand slightly until the stack 48 engages the lip or set of stationary gripping arms of the suction head. In this manner the stack 48 is located in a compressed condition and coupled to the suction head 52.

When the suction head 52 is lowered into the position shown in FIGS. 7-10, the suction cavity 60 lies on top of or adjacent to the top surface of the envelope stack 48. In addition, the envelope moving apparatus 50 and/or suction head 52 may include a pair of rectractable or vertically movable guide plates 84 (FIG. 7A) that receive the envelope stack 48 therebetween to ensure proper alignment of the envelope stack 48 and/or suction head 52.

The mouth 62 of the suction cavity 60 may be sized to match the size of the envelope stack 48 relatively closely. For example, in one embodiment the mouth 62 of the suction cavity 60 and/or the lip 70 is sized to generally match the size of the top surface of the envelope stack 48 such that the lip 70 engages the outer perimeter of the top surface of the envelope stack 48 (see, for example, FIG. 9). In another embodiment, the mouth 62 of the suction cavity 60 and/or the lip 70 is spaced inwardly (or perhaps even outwardly) from the outer perimeter of the top surface of the envelope stack 48. For example, in one case the mouth 62 has a length of about 90% of the length of the top surface of the envelope stack 48 and has a width of about 90% of the width of the top surface of the envelope stack 48. However, the mouth 62 of the suction cavity 60 can have dimension as low as about 50% (or in some cases, even lower) of the respective length and width of the top surface of the envelope stack 48.

The mouth 62 of the suction cavity 60 may have a surface area that is less than 100%, or less than about 90%, or less than about 80%, or less than about 70%, or less than about 60%, or less than about 50% of the surface area of the top surface of the envelope stack 48. Alternately, the mouth 62 of the suction cavity 60 may have a surface area that is at least about 50%, or at least about 60%, or at least about 70%, or at least about 80%, or at least about 90%, or at least about 100% of the surface area of the envelope stack 48. In one embodiment, the mouth 62 of the suction cavity 60 has a width of at least about 3 inches, or at least about 5 inches, or at least about 10 inches and a length of at least about 9 inches, or at least about 12 inches, or at least about 15 inches, or at least about 23 inches. The mouth 62 of the suction cavity 60 may have a surface area of at least about 36 square inches, or at least about 50 square inches, or at least about 100 square inches, or at least about 1000 square inches. The mouth 62 of the suction cavity 60 need not necessarily be rectangular, but instead can have a variety of other shapes.

In the position shown in FIGS. 7-10 the suction cavity 60 lies on top of or adjacent to the top surface of the envelope stack 48. In addition, the arms 74, 76 may be in their engaged position to grip and/or compress the envelope stack 48 therebetween. The suction source 66 is then activated to create suction in the suction cavity 60. The suction in the suction cavity 60 helps to couple the envelope stack 48 to the suction head 52 and, in combination with the gripping arms 74, 76, allows the suction head 52 to lift the envelope stack 48.

The suction source 66 can be any of a variety of suction, vacuum or pump devices which form a vacuum or create suction or reduced pressure. However, in one embodiment the suction source 66 is a "scavenging" suction source which provides a relatively high volume, low pressure differential pressure flow of air. For example, the suction source 66 may provide a pressure differential of less than about 10 inches Hg, or less than about 20 inches Hg, or less than about 30 inches Hg. The suction source 66 may provide an air flow of at least about 30 static cubic feet per minute, or at least about 60 static cubic feet per minute, or at least about 100 static cubic feet per minute, or at least about 150 static cubic feet per minute. Such a suction flow can be provided by a variety of devices, for example by a PREVAC® rotary vacuum pump model SVB25ANN3F sold by Mechanical Ingenuity Corporation of Shrewsbury, N.J.

Due to inefficiencies in the system, the pressure and airflows in the suction chamber 60 will naturally be less than the pressure and airflow provided at the suction source 66. Thus, during operation the suction chamber 60 may provide a pressure differential of less than about 5 inches Hg, or less than about 10 inches Hg, or less than about 20 inches Hg, or less than about 30 inches Hg, and may provide an air flow of at least about 25 static cubic feet per minute, or at least about 50 static cubic feet per minute, or at least about 60 static cubic feet per minute, or at least about 100 static cubic feet per minute, or at least about 150 static cubic feet per minute.

As best shown in FIGS. 8A and 8B, because the envelope stack 48 is not a solid structure, and instead includes a plurality of slots 80 generally formed through its height, air flow flows between the slots 80 during suction, as shown by the arrows of FIG. 8A. Thus a high flow rate is desired to properly secure the envelope stack 48 to the suction head 52. In other words, a high differential pressure/low flow rate vacuum source may not be as effective as the low differential pressure/ high flow rate suction source 66 because any attempt to create high pressure would be largely unsuccessful due to the "porous" nature of the envelope stack 48. In contrast, a low differential pressure/high flow rate suction source is designed to pass large volumes of air therethrough, and therefore may be more suited to use with the porous envelope stack 48.

Figure 11:
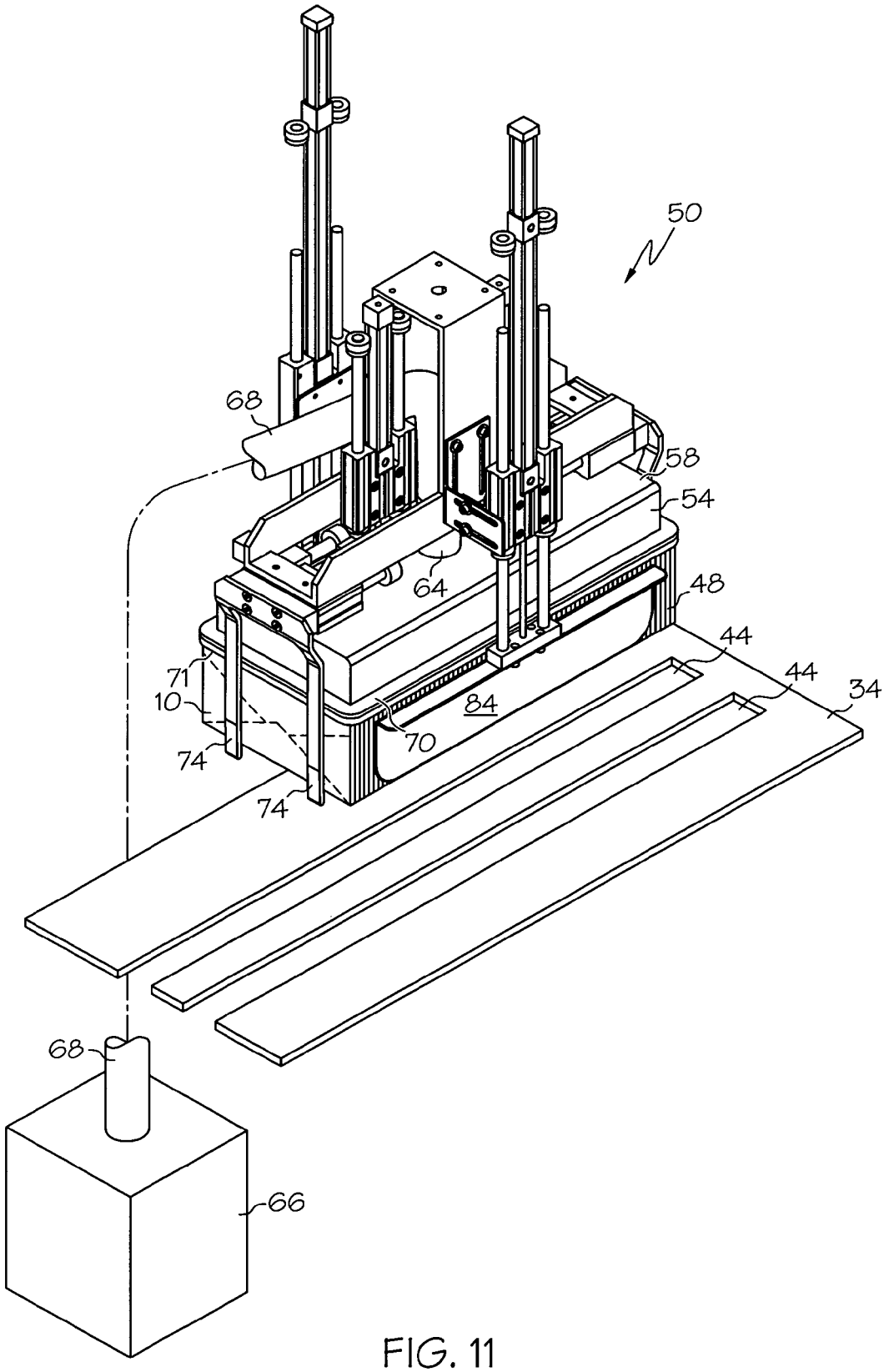
FIG. 11 is a front perspective view of the envelope moving apparatus and envelope stack of FIG. 7A, with the envelope stack lifted off of the support surface.

When the suction device 66 is operated and creates a suction in the suction head 52, and the gripping arms 74, 76 compress the envelope stack 48, the envelope stack 48 is thereby secured to the suction head 52. The suction head 52 can then lift the envelope stack 48 of off the table 34, as shown in FIG. 11. The suction head 52/envelope moving apparatus 50 can then be moved to carry the envelope stack 48 to the desired location. In one embodiment the suction head 52 is movable in two different linear directions such that the suction head 52 has two degrees of freedom (i.e. movable vertically and horizontally). However, if desired the suction head 52 can have one degree of freedom or more than two degrees of freedom, and may also be able to rotate along various axes. The suction head 52 may be movable in an automated manner, for example through the use of linear actuators, motors, pneumatically and the like.

The suction head 52/envelope moving apparatus 50 may be manually movable. When the suction head 52/envelope moving apparatus 50 is manually movable, a counterweight or mechanical assist may be provided to aid such manual movement. For example, the suction head 52/envelope moving apparatus 50 may include a pneumatically counterbalanced mechanical assist, a counterweight, an electromechanical counterweight, or any combination of these devices.

Figure 10:
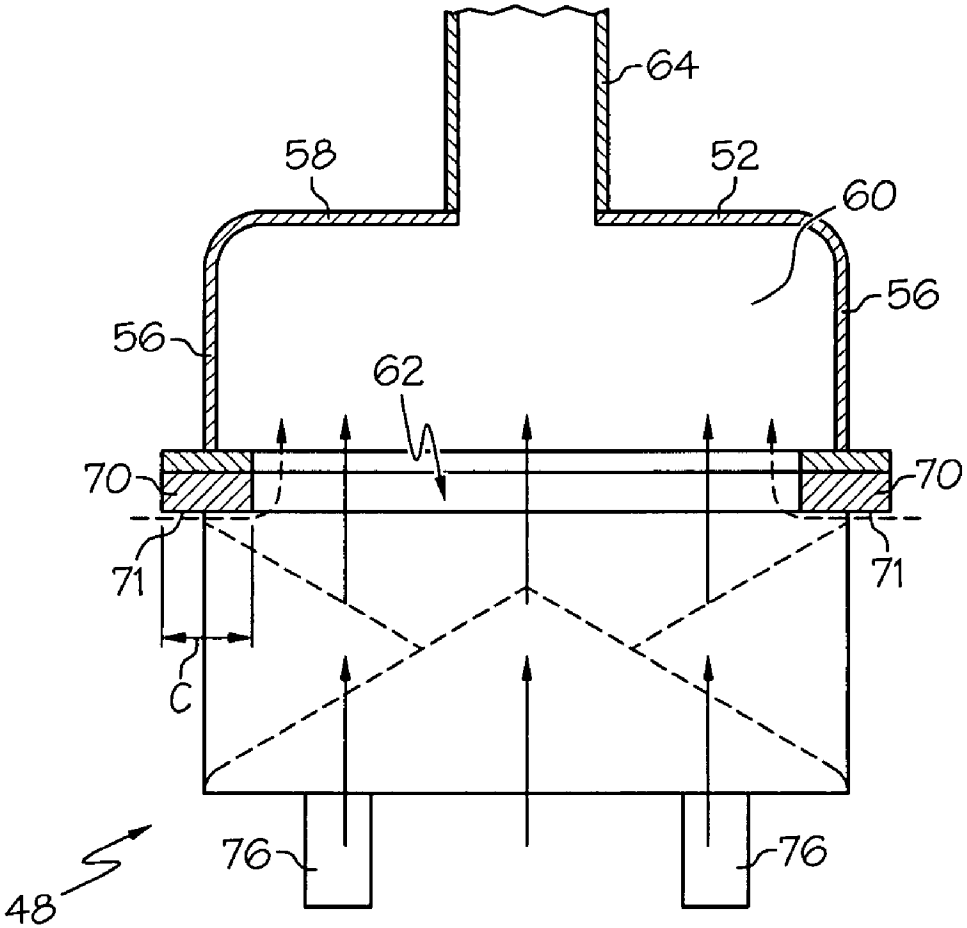
FIG. 10 is a cross section view of the suction head and envelope stack of FIG. 9.

As shown in FIG. 10, the lip 70 of the suction head 52 may be configured to rest upon or adjacent to the outer edges of the top surface of the envelope stack 48. In addition, as described above, the bottom surface 71 of the lip 70 may have a minimum width C. This minimum width ensures a relatively good seal along surface 71 of the lip 70. This seal ensures that the suction travels along the directions of the arrows of FIG. 8 and solid line arrows of FIG. 10, and does not "short-circuit" along surface C (i.e., along the dotted line arrows of FIG. 10). A lip 70 having a bottom surface 71 with a relatively short width may not provide a sufficient seal along surface C and therefore may provide inadequate sealing or suction forces to properly operate.

Figure 12:
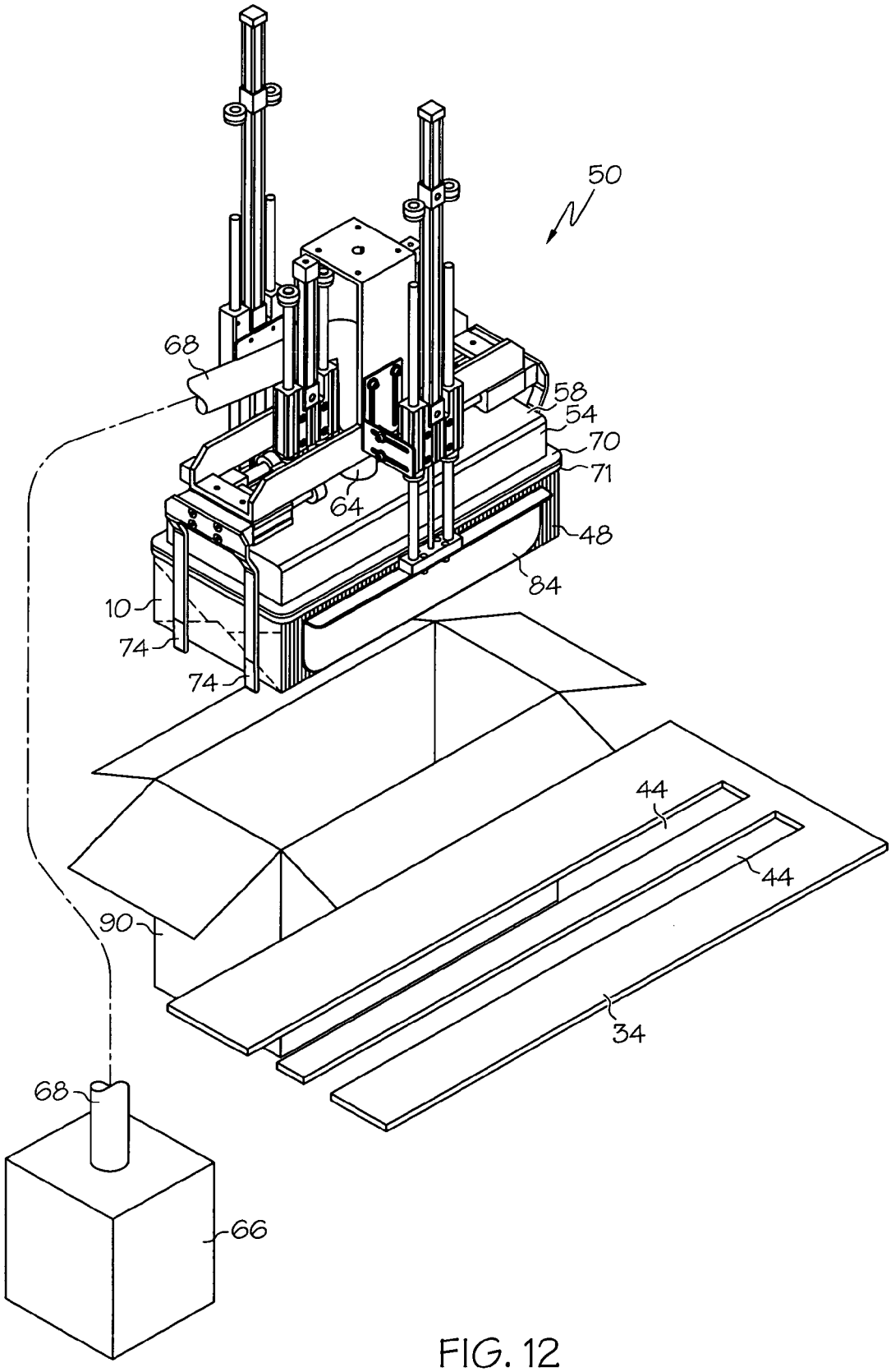
FIG. 12 is a front perspective view of the envelope moving apparatus and envelope stack of FIG. 11, positioned over a packaging box.

In the illustrated embodiment, once the envelope stack 48 is lifted, the suction head 52 and envelope moving apparatus 50 is positioned above a box or stacking tray 90, as shown in FIG. 12. The suction head 52 then lowers the envelope stack 48 until it is located in the box/stacking tray 90. The gripping arms 74, 76 are then moved to their release position and the suction in the suction cavity 60 is terminated or reduced until the envelope stack 48 is released on or in the stacking box/tray. The suction head 52 is then raised and positioned for subsequent lifting and moving operations.

The spiral wheels 32 may continue to rotate and deposit envelopes 10 on the table 34 during the lifting and moving operations of the suction head 52. As shown in FIG. 7, the machine 30 may include a lead pin 77 which provides a backing surface which supports the next envelope stack. The lead pin 77 is coupled to a cylinder 79 such that the lead pin 77 can be retracted into the cylinder 79. The lead pin 77 and cylinder 79 are movable in the downstream direction B as the next envelope stack 48 is created, and can be returned upstream to its position shown in FIG. 7. Thus, once the next envelope stack 48 is created the suction head 52 can lift and/or move the next envelope stack in the same manner outlined above.

The suction assist feature of the suction head 52 cooperates with the gripping arms 74, 76 to lift the envelope stack 48. In this manner the suction head 52/envelope moving apparatus 50 can lift significantly greater amounts of envelopes 10 than gripping arms 74, 76 can lift by themselves. Thus the suction head allows for much quicker and more efficient processing of envelopes 10 and envelope stacks 48.

In addition the suction head 52 allows the envelope stack 48 to be lifted and placed into a container (i.e. a regular slotted container or "RSC"), rather than being pushed or slid into a container. This allows greater flexibility in packaging format, lowers material costs and provides greater flexibility in packaging formats. In addition, because the envelopes 10 are compressed by the suction head 52/gripping arms 74, 76, they can be packaged in a compressed manner which results in space savings and reduced material costs.

Having described the invention in detail and by reference to the various embodiments, it will be apparent that modifications and variations thereof are possible without departing from the scope of the invention.

What is claimed is:

1. An envelope system comprising:

a support surface;

a stack of envelopes positioned on said support surface, said stack of envelopes having a plurality of gaps with each gap being located between an adjacent pair of envelopes of said stack;

a stacking system for creating or placing said stack of envelopes on said support surface; and a suction head applying suction to said stack of envelopes and pulling at least 25 static cubic feet per minute of air at a pressure differential of less than about 30 inches Hg through said plurality of gaps to aid in lifting said stack of envelopes, wherein adjacent envelopes have a gap therebetween at locations where the adjacent envelopes are not touching, wherein each gap has a maximum width, and wherein a compression device applies a compressive force to said stack of envelopes upon operation of said compression device such that the maximum width of each gap between adjacent envelopes of said stack is at least about 0.01 inches.

2. The system of claim 1 wherein said stack of envelopes includes at least about 500 envelopes.

3. The system of claim 1 wherein said stack of envelopes includes at least about 750 envelopes.

4. The system of claim 1 wherein said stack of envelopes includes at least about 1000 envelopes.

5. The system of claim 1 wherein said compression device compresses said stack of envelopes into a compressed condition and retains said stack in said compressed condition when said suction head applies suction to said stack of envelopes.

6. The system of claim 5 wherein said compression device is coupled to said suction head.

7. The system of claim 5 wherein said suction head and said compression device are each movable in an automated manner relative to said stacking system, and wherein said suction head and said compression device are coupled together such that said suction head and said compression device are movable together in said automated manner relative to said stacking system.

8. The system of claim 5 wherein said compression device includes a pair of opposed arms for compressing said stack of envelopes therebetween.

9. The system of claim 5 wherein said compression device is configured to apply a compressive force of less than about seven pounds to said stack of envelopes.

10. The system of claim 1 wherein said suction head includes suction chamber and a plurality of protrusions extending across said suction chamber to block any envelopes from being sucked therein.

11. The system of claim 1 wherein said suction head includes a suction chamber and a lip extending around a perimeter of said suction chamber, said lip having a bottom surface with a width of at least ⅜ inch.

12. The system of claim 11 wherein said lip is made of a material having a hardness of less than 60 Shore A.

13. The system of claim 12 wherein said lip is made of foam.

14. The system of claim 11 wherein said lip is made of generally air-porous material.

15. The system of claim 11 wherein said bottom surface engages at least part of a top surface of said stack of envelopes during use of said suction head.

16. The system of claim 1 further comprising a suction source operatively coupled to said suction head, wherein said suction source is configured to provide an airflow of at least about 60 static cubic feet per minute.

17. The system of claim 1 wherein said suction head includes a suction chamber, said suction chamber having a mouth defining a surface area of at least about 36square inches.

18. The system of claim 1 wherein said suction head is movable in at least two generally opposite linear directions.

19. The system of claim 1 wherein said suction head is movable in at least two sets of generally opposite linear directions.

20. The system of claim 1 wherein each envelope includes a cavity having a mouth and a flap which can selectively cover said mouth.

21. The system of claim 20 wherein each flap includes an adhesive located thereon such that each flap can be adhered to a body of its associated envelope.

22. The system of claim 1 wherein each envelope is generally rectangular in front view and has a plurality of outer edges, and wherein the outer edges of each envelope of said plurality of envelopes are generally aligned such that said stack of envelopes forms a generally rectangular prism.

23. The system of claim 1 wherein said suction head includes a suction chamber, said suction chamber having a mouth defining a surface area of at least about 70% of the surface area of a top surface of said stack of envelopes.

24. The system of claim 1 wherein said stacking system includes at least one rotatable spiral wheel which receives at least part of at least one envelope therein during operation of said spiral wheel.

25. The envelope system of claim 1, wherein the maximum width of each gap between adjacent envelopes of said stack is at least about 0.02 inches.

26. The envelope system of claim 1, wherein said suction head pulls air at a pressure differential of less than about 20 inches Hg through said plurality of gaps.

27. The envelope system of claim 26, wherein said suction head pulls air at a pressure differential of less than about 10 inches Hg through said plurality of gaps.

28. The envelope system of claim 27, wherein said suction head pulls air at a pressure differential of less than about 5 inches Hg through said plurality of gaps.

29. A system for moving envelopes comprising:

a stacking system for creating or placing stack of envelopes on a support surface, said stack of envelopes having a plurality of gaps with each gap being located between adjacent envelopes of said stack; and a suction head for applying suction to said stack of envelopes to pull air through said plurality of gaps to aid in lifting said stack of envelopes;

a compression device;

and a suction source operatively coupled to said suction head, wherein said suction source provides an airflow of at least 25 static cubic feet per minute at a pressure differential of less than about 30 inches Hg through said plurality of gaps upon operation of said suction source;

wherein adjacent envelopes have a gap therebetween at locations where the adjacent envelopes are not touching, wherein each gap has a maximum width, and wherein said compression device applies a compressive force to said stack of envelopes upon operation of said compression device such that the maximum width of each gap between adjacent envelopes of said stack is at least about 0.01 inches.

30. The system of claim 29, wherein the maximum width of each gap between adjacent envelopes of said stack is at least about 0.02 inches.

31. The system of claim 29, wherein said suction source provides said airflow at a pressure differential of less than about 20 inches Hg through said plurality of gaps.

32. The system of claim 31, wherein said suction source provides said airflow at a pressure differential of less than about 10 inches Hg through said plurality of gaps.

33. The system of claim 32, wherein said suction source provides said airflow at a pressure differential of less than about 5 inches Hg through said plurality of gaps.

34. A method for processing a stack of envelopes comprising the steps of:

providing a stack of envelopes on a support surface, said stack of envelopes having a plurality of gaps with each gap being located between adjacent envelopes of said stack;

lifting said stack of envelopes off of said support surface while applying a suction to said stack of envelopes, wherein said applied suction pulls air at an airflow of at least 25 static cubic feet per minute and a pressure differential of less than about 30 inches Hg through said plurality of gaps during said lifting step, wherein adjacent envelopes have a gap therebetween at locations where the adjacent envelopes are not touching, wherein each gap has a maximum width, and wherein a compression device applies a compressive force to said stack of envelopes upon operation of said compression device such that the maximum width of each gap between adjacent envelopes of said stack is at least about 0.01 inches.

35. The method of claim 34 wherein said stack of envelopes includes at least about 500 envelopes.

36. The method of claim 34 wherein said stack of envelopes includes at least about 750 envelopes.

37. The method of claim 34 wherein said stack of envelopes includes at least about 1000 envelopes.

38. The method of claim 34 further comprising the step of compressing said stack of envelopes such that said stack of envelopes is compressed during said lifting step.

39. The method of claim 38 wherein said suction is applied by a suction head and wherein said compressing of said stack is carried out by said compression device, wherein said compression device is coupled to said suction head such that said suction head and said compression device are movable together.

40. The system of claim 39 wherein said compression device includes a pair of opposed arms configured to compress said stack of envelopes therebetween.

41. The method of claim 34 wherein said suction is applied by a suction head having a suction chamber and a lip extending around a perimeter of said suction chamber and which engages an upper surface of said stack of envelopes during said lifting step, said lip having a width of at least about ⅜ inch.

42. The method of claim 41 wherein said suction chamber has a mouth defining a surface area of at least about 36 square inches.

43. The method of claim 34 wherein said suction provides an airflow of at least about 60 static cubic feet per minute.

44. The method of claim 34 wherein said suction is applied by a suction head that is moved in an automated manner in at least two generally opposite linear directions.

45. The method of claim 34 wherein each envelope includes a cavity having a mouth and a flap which can selectively cover said mouth.

46. The method of claim 45 wherein each flap includes an adhesive located thereon such that each flap can be adhered to a body of its associated envelope.

47. The method of claim 34 wherein each envelope is generally rectangular in front view and has a plurality of outer edges, and wherein said providing step includes providing said stack of envelopes such that the outer edges of each envelope of said plurality of envelopes are generally aligned such that said stack of envelopes forms a generally rectangular prism.

48. The method of claim 34, wherein the maximum width of each gap between adjacent envelopes of said stack is at least about 0.02 inches.

49. The method of claim 34, wherein said applied suction pulls air at a pressure differential of less than about 20 inches Hg through said plurality of gaps.

50. The method of claim 49, wherein said applied suction pulls air at a pressure differential of less than about 10 inches Hg through said plurality of gaps.

51. The method of claim 50, wherein said applied suction pulls air at a pressure differential of less than about 5 inches Hg through said plurality of gaps.

52. A suction system for use with a stack of envelopes comprising:

a suction source configured to provide an airflow of at least about 25 static cubic feet per minute; and a suction head having a suction chamber operatively coupled to said suction source and a lip extending around a perimeter of said suction chamber, said lip having a bottom free surface with a width of at least about ⅜ inch;

a compression device;

wherein said stack of envelopes have a plurality of gaps with each gap being located between adjacent envelopes of said stack;

wherein said suction source provides said airflow at a pressure differential of less than about 30inches Hg through said plurality of gaps;

wherein adjacent envelopes have a gap therebetween at locations where the adjacent envelopes are not touching, wherein each gap has a maximum width, and wherein said compression device applies a compressive force to said stack of envelopes upon operation of said compression device such that the maximum width of each gap between adjacent envelopes of said stack is at least about 0.01 inches.

53. The system of claim 52 wherein said suction head includes a pair of side walls defining said suction chamber therebetween, and wherein said bottom surface is oriented generally perpendicular to said side walls.

54. The system of claim 53 wherein said suction head further includes a pair of end walls oriented generally perpendicular to said pair of side walls and to said bottom surface and wherein said suction chamber forms a generally rectangular prism shape.

55. The system of claim 52 further including a stacking system for creating or placing a stack of envelopes on a support surface, and wherein said suction head and suction source are configured to apply suction to said stack of envelopes to pull air through said plurality of gaps to aid in lifting said stack of envelopes.

56. The system of claim 55 wherein said stack of envelopes includes at least about 500 envelopes.

57. The system of claim 55 further comprising wherein said compression device compresses said stack of envelopes and retains said stack in said compressed condition when said suction head applies suction to said stack of envelopes.

58. The system of claim 57 wherein said compression device is coupled to said suction head.

59. The system of claim 57 wherein said suction head and compression device are each movable relative to said stacking system, and wherein said suction head and said compression device are coupled together such that said suction head and said compression device are movable together relative to said stacking system.

60. The system of claim 52 wherein said suction chamber includes a plurality of protrusions extending thereacross to block any envelopes from being sucked therein.

61. The system of claim 52 wherein said lip is made of a material having a hardness of less than about 60 Shore A.

62. The system of claim 61 wherein said lip is made of foam.

63. The system of claim 52 wherein said suction source is configured to provide an airflow of at least about 50 static cubic feet per minute.

64. The system of claim 52 wherein said suction source is configured to provide an airflow of at least about 100 static cubic feet per minute.

65. The system of claim 52 wherein said suction chamber has a mouth about which said lip extends, said mouth defining a surface area of at least about 100 square inches.

66. The system of claim 52 wherein said suction head is movable in an automated manner in at least two generally opposite linear directions.

67. The suction system of claim 52, wherein the maximum width of each gap between adjacent envelopes of said stack is at least about 0.02 inches.

68. The suction system of claim 52, wherein said suction source provides said airflow at a pressure differential of less than about 20 inches Hg through said plurality of gaps.

69. The suction system of claim 68, wherein said suction source provides said airflow at a pressure differential of less than about 10 inches Hg through said plurality of gaps.

70. The suction system of claim 69, wherein said suction source provides said airflow at a pressure differential of less than about 5 inches Hg through said pluralityof gaps.

* * * * *

UNITED STATES PATENT AND TRADEMARK OFFICE

CERTIFICATE OF CORRECTION

PATENT NO. : 7,637,711 B2
APPLICATION NO. : 11/053275
DATED : December 29, 2009
INVENTOR(S) : Wronski et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 891 days.

Signed and Sealed this

Twenty-first Day of December, 2010

David J. Kappos

David J. Kappos
*Director of the United States Patent and Trademark Office*